United States Patent [19]

Davison

[11] Patent Number: 4,604,816

[45] Date of Patent: Aug. 12, 1986

[54] GAITER RANDS

[76] Inventor: George G. Davison, 24 Low Gosforth Court, Melton Park, Newcastle upon Tyne 3, England

[21] Appl. No.: 616,726

[22] Filed: Jun. 4, 1984

[30] Foreign Application Priority Data

Jun. 9, 1983 [IT] Italy ..... 85578 A/83

[51] Int. Cl.[4] ..... A43B 3/16

[52] U.S. Cl. ..... 36/1.5; 36/2 R; 36/7.1 R

[58] Field of Search ..... 36/1.5, 2 R, 2 A, 7.1 R, 36/7.7

[56] References Cited

U.S. PATENT DOCUMENTS

| | | | |
|---|---|---|---|
| 756,560 | 4/1904 | Austin | 36/7.7 |
| 1,632,570 | 7/1922 | Tweedie | 36/2 R |
| 1,640,334 | 8/1927 | Colburn | 36/2 R |
| 2,155,599 | 4/1939 | Hutchison | 36/1.5 |
| 4,005,533 | 2/1977 | Anderson et al. | 36/7.7 |

FOREIGN PATENT DOCUMENTS

| | | | |
|---|---|---|---|
| 0024143 | 2/1981 | European Pat. Off. | 36/2 R |

*Primary Examiner*—Werner H. Schroeder
*Assistant Examiner*—Mary A. Ellis
*Attorney, Agent, or Firm*—Lockwood, Alex, FitzGibbon & Cummings

[57] ABSTRACT

A gaiter rand for application to a boot is of elastic material and has a periphery adapted for attachment to the open bottom of the flexible upper portion of the gaiter. The rand has front and rear openings therein separated by a transverse instep strap, the shapes of the openings conforming with but being of smaller dimensions than those of the sole and heel of the boot. An upstanding rib on the inside surface of the rand extends around at least the front extent of the front opening, while a corresponding groove is formed around at least the toe portion of the sole of the boot. On stretching the rand onto the boot, the openings seal against the sole and heel respectively of the boot while the instep strap seals against the instep, the co-operation of the rib with the groove preventing unintentional removal of the rand from the boot even on substantial flexing of the sole of the boot.

10 Claims, 7 Drawing Figures

GAITER RANDS

BACKGROUND OF THE INVENTION

This invention relates to rands for gaiters to be located on boots or like articles of footwear, particularly walking and climbing boots.

When walking in for example wet, muddy or snowy conditions such as occur in mountaineering, hill-climbing, fell-walking and like activities, it is desirable to wear gaiters over boots with a view to preventing the ingress of water, mud or snow into the boot while at the same time protecting the upper of the boot.

Until recently, such a gaiter has commonly comprised an open-bottomed legging the bottom of which is secured to the sole of a boot by means of straps, wires or other tensioning devices, the legging extending upwardly to cover the upper of the boot and the lower region of the wearer's leg. Such an arrangment successfully prevents direct ingress of undesirable elements into the upper of the boot but the seal between the open bottom of the gaiter and the boot is not such as to prevent said elements making their way up between the gaiter and the boot upper. Thus the boot upper and laces are prone to undesirable wear while the elements eventually make their way into the boot.

Further, the means for attaching the established gaiters to boots are often complex and expensive and are such as to exert a drag effect on the feet of a wearer on walking through mud, snow or the like.

More particularly, the means for attaching the gaiter to a boot commonly comprises a length of wire housed in a seam formed around the open-bottom of the gaiter together with a strap attached to the wire. In order to tension the wire around the welt of the boot, the strap is pulled and is then passed under the instep of the boot and secured to the gaiter by a buckle or like arrangement. In an alternative arrangement the wire may be tensioned by means of a screw clip, requiring the use of a screw-driver to effect the attachment.

It will be appreciated that the presence of straps, buckles, screw clips and the like all contribute towards the cost of the gaiter and are all prone to wear and damage which could result in repair or replacement of the gaiter being necessary.

Furthermore, the tensioned wire does not and cannot engage with the necked part of the boot between the sole and the heel thereof with the result that, as mentioned above, mud, water, snow and the like can make its way up the gaiter between the gaiter and the boot.

Recently there has been introduced a rubber rand of generally oval configuration the outer periphery of which is sewn to the open-bottomed end of the legging, the rand having formed therein an aperture across which extends an instep strap defining front and rear openings for the sole and heel of the boot respectively. In use of such a rand, the boundaries of the front and rear openings are stretched to extend around, and make sealing contact with, the sole and heel portions of the welt of the boot respectively with the instep strap of the rand extending underneath the boot between the sole and the heel thereof.

Such an arrangement provides an effective seal all the way round the welt of the boot such as to prevent the ingress of undesirable material between the boot and the gaiter whereby the wearer's foot remains dry and the boot upper and laces are protected to give added life thereto. Further, the absence of buckles, clips and like securing means reduces the drag on the boot compared with the above-mentioned established arrangements.

However, retention of the rand on the boot is dependent upon the stretch of the material of the rand. Whilst suitable for boots with a stiffened sole construction where little bending of the sole occurs during use, such rands, when applied to boots or like articles of footwear having flexible soles, having a tendency to peel away from the toe of the boot on bending of the sole, thus exposing the boot upper and laces to the elements and defeating the purpose of the gaiter.

SUMMARY OF THE INVENTION

It would be desirable to be able to provide a rand for a gaiter which was less likely to become displaced from its operative position on the boot and which could be applied effectively to boots with flexible soles as well as stiffened soles.

According to the present invention there is provided a rand for a gaiter to be applied to a boot or like article of footwear, the boot having a groove formed around at least the toe portion of the upstanding sidewall of the sole thereof, the rand being of elastic material, preferably rubber, and having a periphery adapted for connection to a flexible upper portion of the gaiter, the rand having an aperture formed therethrough across which extends an instep strap defining front and rear openings the shapes of which conform substantially with those of the sole and heal respectively of the boot but the dimensions of which are less than the corresponding external dimensions of said sole and heel, an upstanding rib being formed on the inside surface of the rand around at least the front extent of the boundary of the front opening, the arrangement being such that, on positioning of the rand on the boot, the boundaries of the front and rear openings are stretched such that the rib around the front openings is located in the groove formed in the sidewall of the sole of the boot to make sealing contact therewith and the rear opening extends around the heel of the boot to make sealing contact therewith, the instep strap extending across the base of the boot between the sole and the heel thereof.

In such an arrangement, the provision of the rib on the rand and the groove in the sole of the boot is such as to maintain the rand in an effective operative position even on boots having soles of an extremely flexible nature, in that any peeling away of the rand at the toe of the boot is prevented by co-operation between said rib and groove in combination with the location resulting from the inherent stretch of the material of the rand.

Thus it will be appreciated that the provision of the co-operating rib and groove serves to overcome the problems associated with the existing arrangement and enables gaiters incorporating such rands to be used successfully on a wider range of footwear than heretofore and in particular walking and climbing boots having relatively flexible soles.

Preferably the rib is formed around all but the transverse extent of the boundary of the front opening and is received in a groove formed right round the upstanding sidewall of the sole of the boot.

In a preferred rand, the ends of the rib are chamfered to improve the sealing contact of the rand with the boot at the region of transition between the instep strap and the adjacent portions of the rand.

Conveniently said instep strap is of greater thickness than the remainder of the rand, the front and rear edges of the instep strap being adapted to seal against the rear of the sole tread and the front of the heel tread respectively, the peripheral regions of the rand, in use, bending upwardly about the lateral edges of said increased-thickness instep strap.

The outer surface of the instep strap may have an outstanding tread pattern formed thereon, while the outer surface of the rand may include an increased-thickness bead surrounding each of the front and rear openings therein as well as an increased thickness bead bounding the periphery thereof.

DESCRIPTION OF THE PREFERRED EMBODIMENTS

Figure 1:
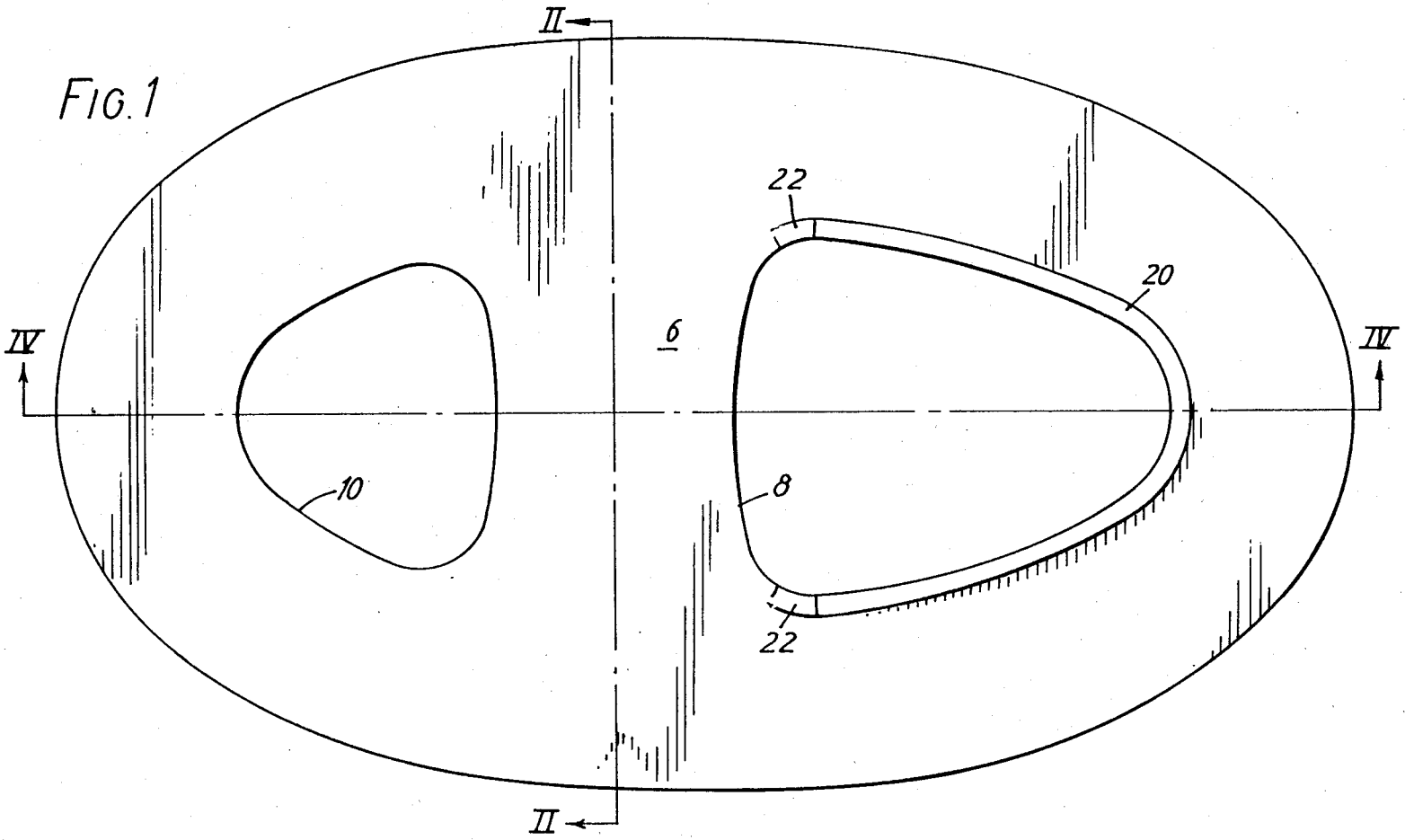
FIG. 1 is a plan view from above showing the inner face of a rand according to the invention.

Referring to the drawings, the illustrated rand is moulded from waterproof elastic material, preferably rubber, and is of generally oval form, asymmetrically shaped about the minor axis and symmetrically shaped about the major axis. The periphery of the rand conforms substantially in size and shape with the periphery of the open-bottom of the upper portion of a gaiter of which the rand is to form part, said upper portion, part of which is shown at 1 in FIG. 5, conveniently being of flexible fabric material such as canvas or waterproofed nylon zipped along its length. The open-bottom of the upper portion of the gaiter 1 is indicated at "3" in FIG. 6. A continuous channel 2 is formed in an outwardly projecting bead 4 integrally moulded on the rand to extend right round the periphery of the outer surface of said rand. The rand and the bottom of the upper portion of the gaiter are sewn together by thread passing through the rand and the upper portion with the individual stitches being housed within the channel 2, the rand thus extending across the open-bottom of the upper portion to form a base to the gaiter with the adjoined peripheries of the two parts of the gaiter being in an unstretched condition.

A substantially central aperture is formed through the rand across which extends an instep strap 6 to define front and rear openings 8,10 respectively in the rand. The shapes of the openings 8,10 conform substantially with the shapes of the sole and heel respectively of standard walking or climbing boots, but the internal dimensions of said openings are proportionately less than the corresponding external dimensions of said sole and heel for reasons which will become apparent.

Figure 2:
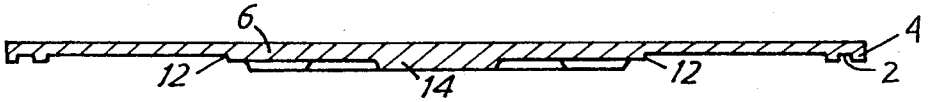
FIG. 2 is a section on line II—II of FIG. 1.
Figure 3:
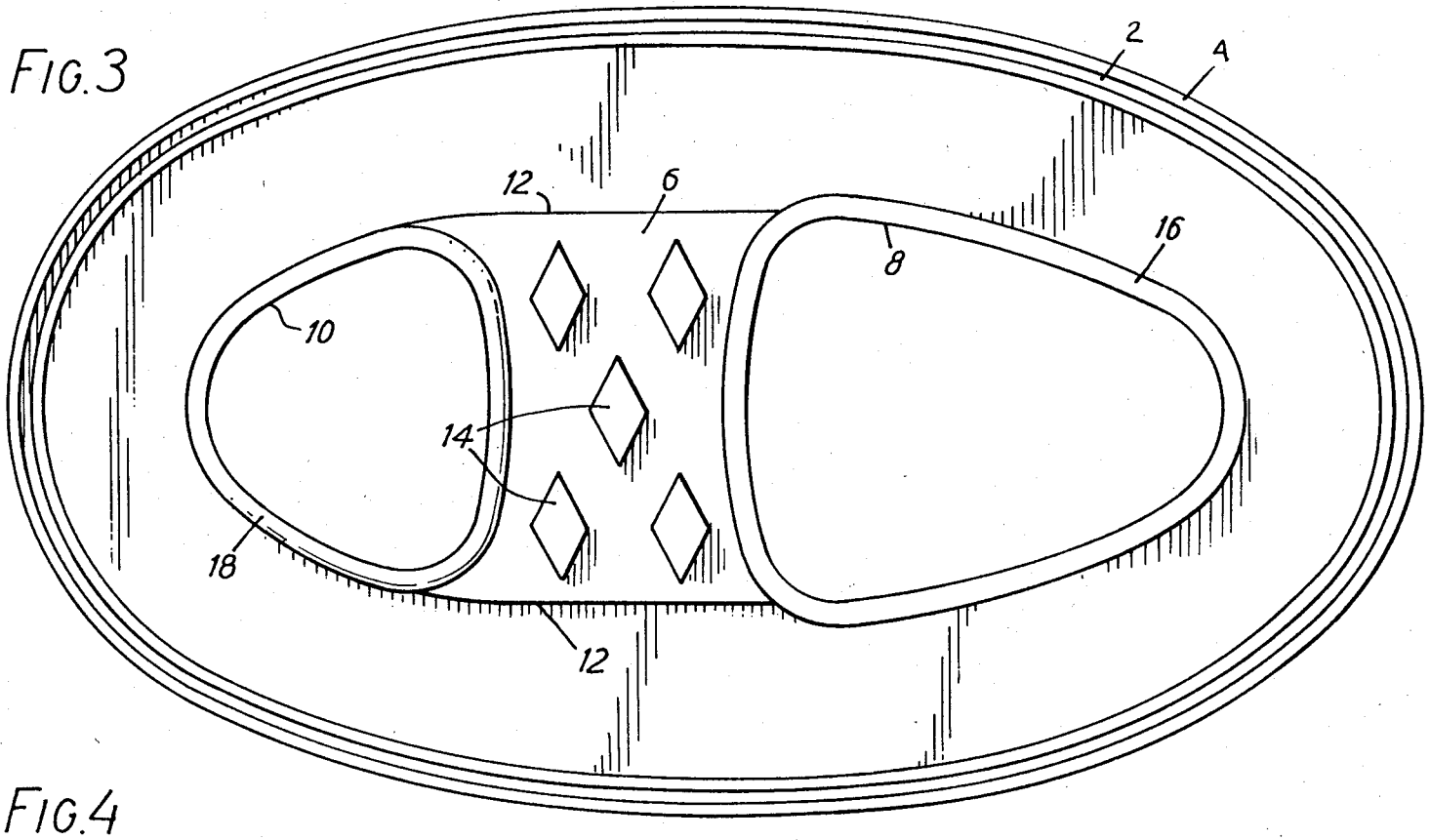
FIG. 3 is a plan view from below showing the outer face of the rand of FIGS. 1 and 2.
Figure 4:
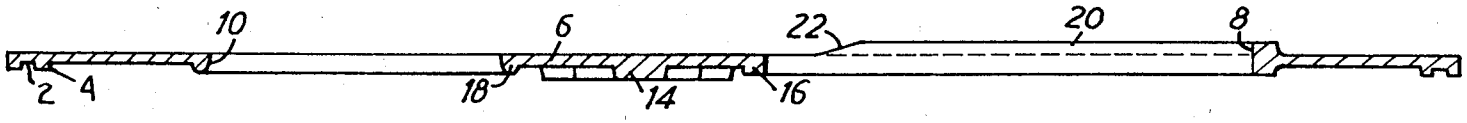
FIG. 4 is a section on line IV—IV of FIG. 1.

The instep strap 6 is integrally moulded with the rand but is of increased thickness compared with the rest of the rand as is best illustrated in FIG. 2. The instep strap 6 terminates at each end in edges 12 and has a tread pattern 14 formed on the outer surface thereof.

On the outer surface of the rand, the openings 8,10 are surrounded by upstanding beads 16,18 integrally moulded in the rand.

The upper surface of the rand is smooth apart from the provision of an upstanding rib 20 integrally moulded with the rand and surrounding all but the rear transverse extent of the opening 8. The ends of the rib 20 are chamfered at 22 whereby said rib 20 terminates at points substantially above the ends of the edges 12 of the instep strap 6.

Figure 5:
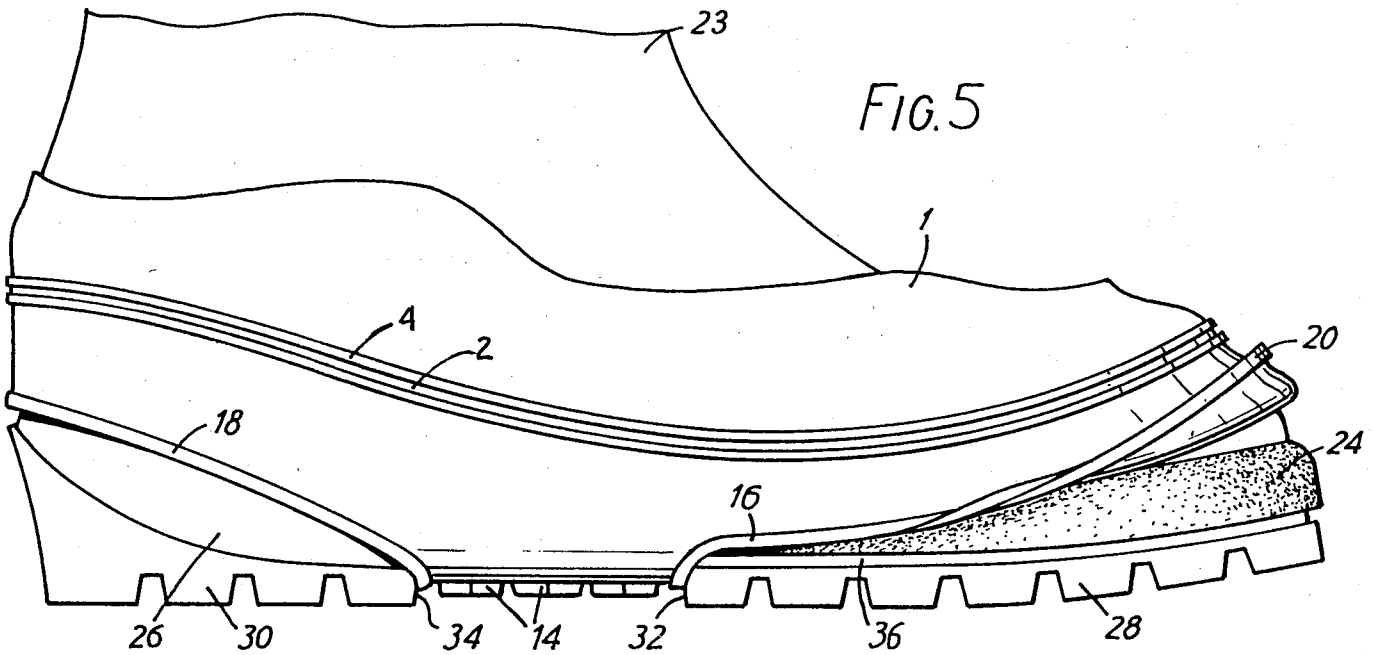
FIG. 5 shows the rand of FIGS. 1 to 4 embodied in part of a gaiter partly in position on a boot.
Figure 7:
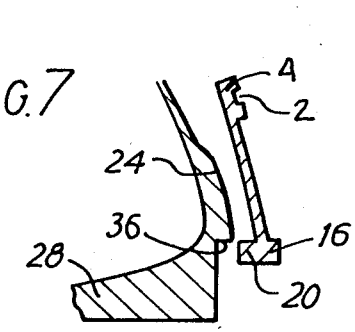
FIGS. 6 and 7 are details of alternative rand and boot arrangements according to the invention.
Figure 6:
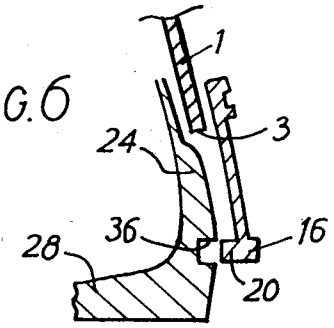

A gaiter incorporating the described rand is used on a boot such as that shown in part in FIG. 5 and including an upper 23, a sole 24 on whch is formed a sole tread 28, and a heel 26 on which is formed a heel tread 30, the treads 28,30 being separated by an instep to the boot the front of which is defined by the rear face 32 of the sole tread 28 and the rear of which is defined by the front face 34 of the heel tread 30. A groove 36 is formed around the side edge of the sole immediately above the tread 28, said groove terminating at each side of the sole at points adjacent and above the ends of the face 32 of the tread 28 and being of a shape to receive therein the rib 20 of the rand. The groove 36 may be of rectangular shape in transverse section as shown in FIG. 6, conforming with the rectangular cross-section of the rib 20 of the rand, or may be of L-shape in transverse section as shown in FIG. 7 to provide an upper abutment surface for the abutting edge of the rib 20 of the rand.

Location of the gaiter and rand on the boot is conveniently done with the boot actually being worn. With the upper portion or legging of the gaiter fully unzipped, the front of the opening 8 in the rand is positioned over the toe of the boot with the front extent of the rib 20 located in the front extent of the groove 36, and the rand is stretched rearwardly from the toe of the boot until the rear transverse extent of the opening 8—i.e. the front edge of the instep strap 6—abuts against the face 32 of the tread 26 and the whole of the rib 20 is received in the groove 36. With the instep strap 6 located between the faces 32 and 34, the rear end of the rand is stretched rearwardly and upwardly such that the opening 10 is stretched over the heel of the boot. The rear end of the rand is then pulled upwards until the operative position shown in FIG. 5 is achieved.

In this position of the rand, the elastic nature of the material of the rand ensures that the boundaries of the openings 8,10 make sealing contact with the associated regions of the sole and heel of the boot right around said sole and heel, while the instep strap 6 seals against the instep of the boot.

More particularly, a differential stretch exists across the rand increasing from zero around the periphery of the rand at its region of attachment to the upper portion of the gaiter to a maximum value at the boundaries of the openings 8,10, with the tension in the instep strap causing the rand to seal against the instep of the boot. The provision of the chamfers 22 at the ends of the rib 20 ensures continuous engagement of the inner surface of the rand with the boot at the region of transition between the sole and the instep. Further, the lateral edges 12 of the thickened instep strap 6 provide lines about which the adjacent portions of the rand bend upwardly on application of the rand to the boot.

It will be appreciated that the positive co-operation between the rib 20 on the rand and the groove 36 in the sole of the boot ensures that the rand remains in its operative position on the boot even on substantial flexing of the sole of the boot, there being no tendency for the toe end of the rand to peel away from, and expose, the toe of the boot as has happened in known arrangements.

The sidewall of the heel 26 of the boot is conveniently of slightly outwardly-convex shape in transverse section to improve the sealing contact of the boundary of the opening 10 therewith.

In addition to providing positive retention of the rand on the boot, the described arrangement also ensures full protection to both the boot and the wearer's leg and foot against snow or water penetration and therefore against cold. Thus the boot uppers and laces are protected from rocks, scree, abrasion and constant soakings, thereby increasing the potential life of a boot by a significant amount.

The gaiter is of smooth external shape with no straps, wires or other devices present to exert a drag on the wearer when walking through snow, mud or the like, while there are no 'mechanical' parts to rust or otherwise deteriorate or malfunction.

Although described as extending around the whole of the upstanding sidewall of the sole 24 of the boot, the groove 36 may be formed around only the toe portion of the sidewall of the sole 24, with the rib 20 being formed around a corresponding front part only of the boundary of the opening 8.

What I claim and desire to secure by Letters Patent is:

1. A rand for a gaiter to be applied to a boot, the boot having a sole and a heel, the sole including an upstanding sidewall and the gaiter including a flexible upper portion, the rand being of elastic material and having a periphery adapted for connection to the flexible upper portion of the gaiter, the rand defining therein an aperture across which extends an instep strap defining front and rear openings the shapes of which conform substantially with those of the sole and heel respectively of the boot but the dimensions of which are less than the corresponding external dimensions of said sole and heel, at least the toe portion of the upstanding sidewall of the sole of the boot having a groove formed therearound and a rib being formed on the inside surface of the rand around at least the front extent of the boundary of the front opening, the arrangement being such that, on positioning of the rand on the boot, the boundaries of the front and rear openings are stretched such that the rib around the front opening is located in the groove formed in the sidewall of the sole of the boot to make sealing contact therewith and the rear opening extends around the heel of the boot to make sealing contact therewith, the instep strap extending across the base of the boot between the sole and the heel thereof.

2. A rand as claimed in claim 1 in which the rib is formed around all but the rear transverse extent of the boundary of the front opening, to be received in a groove formed around the upstanding sidewall of the sole of the boot.

3. A rand as claimed in claim 2 in which the ends of the rib are chamfered such as to effect sealing contact of the rand with the boot at the region of transition between the instep strap and the adjacent portions of the rand.

4. A rand as claimed in claim 3 in which the instep strap is of greater thickness than the remainder of the rand, the sole and heel of the boot having associated treads thereon, the front and rear edges of the strap being adapted to seal against the rear of the sole tread and the front of the heel tread respectively, the peripheral regions of the rand, in use, bending upwardly about the lateral edges of said increased-thickness instep strap.

5. A rand as claimed in claim 4 in which a tread pattern is formed on the outer surface of the instep strap, an increased-thickness bead on the outer surface of the rand surrounding each of the front and rear openings therein and a further increased-thickness bead bounding the periphery of the rand.

6. A gaiter to be applied to a boot of the type having an upper, a heel and a sole, the sole including an upstanding sidewall, said gaiter comprising a flexible upper portion shaped to fit over the upper of the boot and having an open-bottom and a rand, the rand being of elastic material and having a periphery adapted for connection to the periphery of the open-bottom of the flexible upper portion so as to form a base to the gaiter, the rand defining therein an aperture across which extends an instep strap defining front and rear openings the shapes of which conform substantially with those of the sole and heel respectively of the boot but the dimensions of which are less than the corresponding external dimensions of said sole and heel, at least the toe portion of the upstanding sidewall of the sole of the boot having a groove formed therearound and a rib being formed on the inside surface of the rand around at least the front extent of the boundary of the front opening, the arrangement being such that, on positioning of the rand on the boot, the boundaries of the front and rear openings are stretched such that the rib around the front opening is located in the groove formed in the sidewall of the sole of the boot to make sealing contact therewith and the rear opening extends around the heel of the boot to make sealing contact therewith, the instep strap extending across the base of the boot between the sole and heel thereof.

7. A gaiter as claimed in claim 6 in which the upper portion is of flexible, non-elastic material and the rand is of rubber such that, on location of the gaiter on the boot, a differential stretch is established in the rand increasing from zero at the periphery thereof to a maximum value at the boundaries of the front and rear openings therein.

8. A boot, having a sole and a heel, for receiving thereon a gaiter of the type having a flexible upper portion and a rand, said sole having an upstanding sidewall, the rand being of elastic material and having a periphery adapted for connection to the flexible upper portion of the gaiter, the rand defining therein an aperture across which extends an instep strap defining front and rear openings the shapes of which conform substantially with those of the sole and heel respectively of said boot but the dimensions of which are less than the corresponding external dimensions of said sole and heel, the rand having a rib formed on the inside surface thereof around at least the front extent of the boundary of the front opening, the arrangement being such that, on positioning of the rand on said boot, the boundaries of the front and rear openings are stretched such that the rib around the front opening engages said upstanding sidewall of said sole to make sealing contact therewith and the rear opening extends around said heel to make sealing contact therewith, the instep strap extending across the base of the boot between the sole and heel thereof, said boot having a groove formed in said upstanding sidewall of said sole around at least the toe portion thereof for receiving the rib formed on the inside surface of the rand to retain the rand on said boot.

9. A boot as claimed in claim 8 wherein said groove extends fully around said upstanding sidewall of said sole.

10. A boot as claimed in 8 in which the sidewall of the heel of said boot is of generally outwardly convex shape in transverse section.

* * * * *